United States Patent [19]

Ong et al.

[11] Patent Number: 5,077,167

[45] Date of Patent: Dec. 31, 1991

[54] ENCAPSULATED TONER COMPOSITIONS

[75] Inventors: Beng S. Ong, Mississauga; Barkev Keoshkerian, Thornhill, both of Canada

[73] Assignee: Xerox Corporation, Stamford, Conn.

[21] Appl. No.: 546,616

[22] Filed: Jun. 29, 1990

[51] Int. Cl.[5] ..... G03G 9/08

[52] U.S. Cl. ..... 430/109; 430/110; 430/137

[58] Field of Search ..... 430/109, 110, 137; 564/307

[56] References Cited

U.S. PATENT DOCUMENTS

| | | | |
|---|---|---|---|
| 4,455,362 | 6/1984 | Naoi et al. | 430/137 |
| 4,465,755 | 8/1984 | Kiritani et al. | 430/111 |
| 4,520,091 | 5/1985 | Kakimi et al. | 430/110 |
| 4,575,478 | 3/1986 | Ohno | 430/109 |
| 4,642,281 | 2/1987 | Kakimi et al. | 430/138 |
| 4,758,506 | 7/1988 | Lok et al. | 430/903 |
| 4,833,057 | 5/1989 | Misawa et al. | 430/109 |
| 4,877,706 | 10/1989 | Mahabadi et al. | 430/106.6 |

*Primary Examiner*—Marion E. McCamish
*Assistant Examiner*—S. Rosasco
*Attorney, Agent, or Firm*—E. O. Palazzo

[57] ABSTRACT

An encapsulated tone composition comprised of a core comprised of a polymer binder, pigment, and a polymeric shell derived from polycondensation of a glycidyl functionalized reagent and a polyisocyanate with a polyamine.

44 Claims, No Drawings

ENCAPSULATED TONER COMPOSITIONS

BACKGROUND OF THE INVENTION

The present invention is generally directed to toner compositions, and more specifically to encapsulated toner compositions. In one embodiment, the present invention relates to encapsulated toner compositions comprised of a core comprised of a polymer resin or resins, and colorants, and a polymeric shell thereover prepared, for example, by interfacial polymerization and comprised in an embodiment of a condensation polymer derived from the reaction of glycidyl-functionalized reagents and polyisocyanates with polyamines. The aforementioned polymeric shell may also contain a soft, flexible component such as a polyether moiety primarily for the purpose of improving the packing of the shell materials. Proper packing of the shell components permits, for example, a high density shell structure, and lowers, suppresses, or in some instances eliminates the shell's permeability especially to the core resins. A high degree of shell permeability is primarily responsible for the leaching or bleeding of core binder from the toner, causing the problems of toner agglomeration or blocking, and image ghosting in imaging and printing processes, which problems are avoided or minimized with the toners of the present invention. One embodiment of the present invention relates to encapsulated toner compositions comprised of a core of polymer resin and colorants, which core is encapsulated by condensation polymers formed by interfacial polymerization between a mixture of glycidyl-functionalized reagents and polyisocyanates with polyamines, whereby there are enabled toners with many of the advantages illustrated herein including excellent high image fixing characteristics, the absence or minimization of toner agglomeration, the absence or minimization of image ghosting, and retention or substantial retention of the core components, avoiding or minimizing toner agglomeration. In another embodiment, the present invention relates to a pressure fixable encapsulated toner composition wherein the shell is comprised of the reaction product of a mixture of a glycidyl-functionalized reagent or reagents, a polyisocyanate or polyisocyanates selected, for example, from the group consisting of benzene diisocyanate, toluene diisocyanate, diphenylmethane diisocyanate, polymethylene diisocyanate, and other aliphatic and aromatic polyisocyanates with a polyamine. The aforementioned toners possess a number of advantages as illustrated herein, including preventing or minimizing leaching or loss of the core components, espeically the core resin. In another embodiment of the present invention, the toner compositions obtained include thereon an electroconductive material thereby rendering the compositions relatively conductive with a controlled and stable volume resistivity such as, for example, from about $10^3$ to about $10^8$ ohm-cm, and preferably from about $5\times10^4$ and $5\times10^7$ ohm-cm, which toners are particularly useful for inductive single component development processes.

Examples of advantages associated with the toner compositions of the present invention in embodiments thereof are as indicated herein, and include excellent image fix and image crease, rub and abrasion resistance, the elimination and/or the minimization of image ghosting, excellent fixing characteristics, acceptable surface release properties, substantially no toner agglomeration, acceptable powder flow characteristics, and minimal or no leaching of the core components. Also, the toners of the present invention in embodiments thereof possess a shell with substantially improved mechanical properties thus permitting, for example, improved toner shelf stability; and moreover, the shell precursors selected possess in many instances low vapor pressures, thus reducing environment hazards, which is not the situation with some of the prior art toner shells. Further, with the toner compositions of the present invention, in various embodiments the shell does not rupture prematurely causing the core component comprised, for example, of a polymer resin and magnetite, or other pigment to become exposed, which upon contact with other toner particles or reprographic development subsystem component surfaces and the like can form undesirable agglomerates. The excellent surface release properties possessed by the toners of the present invention provide for a complete or substantially complete transfer of toned images to a paper substrate during the development process, thus rendering this process very efficient. Furthermore, the toner compositions of the present invention can be obtained in high reaction yields in several embodiments thereof, and the preparative process can involve a simple washing and sieving procedure to remove the undesirable coarse and fine particles without utilizing the costly conventional particle size classification step. The toner compositions of the present invention can be selected for a variety of known reprographic imaging processes including electrophotographic and ionographic processes. In an embodiment, the toner compositions of the present invention are selected for pressure fixing processes, for ionographic printing wherein dielectric receivers, such as silicon carbide, are utilized, reference U.S. Pat. No. 4,885,220, the disclosure of which is totally incorporated herein by reference. In one embodiment, the toner compositions of the present invention can be selected for image development in commercial Delphax printers such as the Delphax S9000 TM, S6000 TM, S4500 TM, S3000 TM, and Xerox Corporation printers such as the 4060 TM and 4075 TM wherein, for example, transfixing is utilized, that is fixing of the developed image is accomplished by simultaneously transferring and fixing the developed images onto a paper substrate with pressure. Another application of the toner compositions of the present invention is for two component development systems wherein, for example, the image toning and transfer are accomplished electrostatically, and the fixing of the transferred image is achieved by application of pressure with or without the assistance of thermal energy.

The toner compositions of the present invention can, in one embodiment, be prepared by interfacial polymerization involving microcapsule shell-forming polycondensation, followed by an in situ core resin forming, free radical polymerization of a core monomer or monomers in the presence of a free radical initiator. Thus, in one embodiment the present invention is directed to a process for a simple and economical preparation of pressure fixable encapsulated toner compositions by interfacial/free-radical polymerization methods wherein there are selected core monomers, pigments, a free radical initiator, and certain shell precursors capable of providing, after interfacial polycondensation, a polar condensation polymer shell which contains polar functional groups such as urea, urethane, glycidyl and hydroxy functions. Other process embodiments of the present invention relate to, for example, interfacial/free radical polymerization methods for obtaining encapsulated colored toner compositions. Further, in another process aspect of the present invention the encapsulated toners can be prepared in the absence of solvents thus eliminating explosion hazards associated therewith and the expensive and hazardous solvent separation and recovery steps. Moreover, with the process of the present invention in an embodiment there are obtained improved toner throughput yields per unit volume of reactor size. The toners of the present invention are useful for permitting the development of images in reprographic imaging systems, inclusive of electrostatographic and ionographic imaging processes wherein pressure fixing is selected, and for other imaging and printing processes.

The toner compositions of the present invention contain unique shell materials that permit the containment or substantial retention of the core components, thus eliminating or substantially suppressing core resin diffusion and leaching in embodiments. As a consequence, the problems of toner agglomeration and image ghosting can be completely or substantially eliminated. Furthermore, the toner compositions of the present invention dramatically improve the efficiency of the image transfer process to substrates such as paper in many embodiments. Also, with the toner compositions of the present invention, particularly with respect to their selection for single component inductive development processes, the toner particles can contain on their surfaces a uniform and substantially permanently attached electroconductive materials thereby imparting stable electroconductive characteristics to the particles inclusive of situations wherein these particles are subjected to vigorous agitation. With many of the prior art toners, the surface conductivity properties of the toner particles may be unstable when subjected to agitation, especially for example, when electroconductive dry surface additives such as carbon black are selected. Further, with the aforementioned prior art toner compositions, there are in many instances obtained images of low quality with substantial background deposits, particularly after a number of imaging cycles, especially subsequent to vigorous mechanical agitation which results in toner electroconductivity instability since the additives, such as carbon black, are not permanently retained on the surface of the toner. Additionally, several of the cold pressure fixing toner compositions of the prior art have other disadvantages in that, for example, these compositions are obtained by processes which utilize organic solvents as diluting or reaction media. The utilization of organic solvents renders the preparative process costly and potentially hazardous since most organic solvents are flammable and explosion-prone, and such processes also require expensive solvent separation and recovery steps. Moreover, the inclusion of solvents also decreases the toner throughput yield per unit volume of reactor size. Furthermore, with many of the prior art processes toners of narrow size dispersity cannot be easily achieved as contrasted with the process of the present invention where narrow particle size distributions are generally obtained in embodiments thereof. In addition, many prior art processes provide deleterious effects on toner particle morphology and bulk density as a result of the removal of solvent and the subsequent collapse or shrinkage of toner particles during the toner work-up and isolation processes resulting in a toner of very low bulk density. These disadvantages are substantially eliminated with the toners and processes of the present invention. More specifically, thus with the encapsulated toners of the present invention control of the toner physical properties of both the core and shell materials can be achieved in embodiments thereof. Specifically, with the encapsulated toners of the present invention undesirable leaching or loss of core components is avoided or minimized, and image ghosting is eliminated in many instances primarily in view of the presence of the polar functional groups within the shell polymer, and thus the low permeability characteristics of the shell structure to the core components. Image ghosting is an undesirable phenomenon encountered in ionographic transfix development when, for example, certain toner compositions are utilized. It refers to the repetitious printing of unwanted images, and arises primarily from the contamination of the dielectric receiver by the unremovable residual toner materials. This problem can sometimes be partially eliminated by the use of suitable surface release agents which aids in the removal of residual toner materials after image transfer. The toner compositions of the present invention eliminate or substantially eliminate the image ghosting problem by providing a microcapsule shell which effectively contains the core resin, inhibiting its leaching, and prevents it from coming into contact with the dielectric receiver during the image toning and transfix processes. In addition, the shell materials of the present invention in embodiments thereof also provides excellent surface release properties, thus enabling efficient removal of residual toner materials from the dielectric receiver surface. Furthermore, the excellent surface release properties afforded by the shell can dramatically enhance the image transfer efficiency of the transfix development processes.

A poly(aminohydrin-urethane) shell of the present invention in an embodiment thereof is obtained by the copolymerization of a bis(epoxy)-functionalized monomer with a diamine in the presence of a diisocyanate. The amino content of the shell can vary, however, those with an aminohydrin content of less than 30 mole percent and from about 1 to about 25 mole percent can exhibit excellent resistance to toner agglomeration in embodiments of the present invention.

Encapsulated cold pressure fixable toner compositions are known. Cold pressure fixable toners have a number of known advantages in comparison to toners that are fused by heat, primarily relating to the utilization of less energy since the toner compositions selected can be fixed without application of heat. Nevertheless, some of the prior art cold pressure fixable toner compositions suffer from a number of deficiencies. For example, these toner compositions must usually be fixed under high pressure, which generally shortens the useful life of the imaging components such as the dielectric receiver or pressure roll. High pressure fixing can also result in unacceptable paper calendering. Also, a number of the prior art cold pressure fixable toner compositions, particularly those prepared by conventional melt blending processes, do not usually provide high image fix levels. As a result, these images can be of low fix levels, and of low crease, rub and smear resistant. Additionally, some of the cold pressure fixing toner compositions of the prior art have other disadvantages in that, for example, these compositions when fixed under high pressure provide, in some instances, images of low resolution and high image gloss.

In a patentability search report, the following United States patents were listed; U.S. Pat. No. 4,833,057 which discloses a toner comprising as a main component a urethane-modified polyester obtained by reacting a polyester resin with an isocyanate compound, see for example the Abstract of the Disclosure; U.S. Pat. No. 4,575,478 which discloses a toner comprising an epoxy resin, or modified epoxy resin obtained by the reaction of an epoxy resin with a polyfunctional compound having at least two carboxyl or amino groups per molecule, and a bivalent or polyvalent metal complex compound, see the Abstract of the Disclosure for example; neither of the aforementioned patents, according to the search report, disclose an encapsulated toner; and U.S. Pat. Nos. 4,455,362; 4,464,281; 4,520,091 and 4,877,706, which relate to encapsulated toners with shells obtained from diisocyanates and from diepoxy/diamine copolymers.

The following U.S. patents are mentioned: U.S. Pat. No. 3,967,962 which discloses a toner composition comprising a finely divided mixture comprising a colorant material and a polymeric material which is a block or graft copolymer, including apparently copolymers of polyurethane and a polyether (column 6), reference for example the Abstract of the Disclosure, and also note the disclosure in columns 2 and 3, 6 and 7, particularly lines 13 and 35; however, it does not appear that encapsulated toners are disclosed in this patent; U.S. Pat. No. 4,565,764 which discloses a microcapsule toner with a colored core material coated successively with a first resin wall and a second resin wall, reference for example the Abstract of the Disclosure and also note columns 2 to 7, and particularly column 7, beginning at line 31, wherein the first wall may comprise polyvinyl alcohol resins known in the art including polyurethanes, polyureas, and the like; U.S. Pat. No. 4,626,490 contains a similar teaching as the '764 patent, and more specifically discloses an encapsulated toner comprising a binder of a mixture of a long chain organic compound and an ester of a higher alcohol and a higher carboxylic acid encapsulated within a thin shell, reference the Abstract of the Disclosure, for example, and note specifically examples of shell materials in column 8, beginning at line 64, and continuing on to column 9, line 17, which shells can be comprised, for example, of polyurethanes, polyurea, epoxy resin, polyether resins such as polyphenylene oxide or thioether resin, or mixtures thereof; and U.S. patents of background interest include U.S. Pat. Nos. 4,442,194; 4,465,755; 4,520,091; 4,590,142; 4,610,945; 4,642,281; 4,740,443 and 4,803,144.

There are disclosed in U.S. Pat. No. 4,307,169, the disclosure of which is totally incorporated herein by reference, microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes can be selected for the preparation of the toners of this patent. Also, there are disclosed in the prior art encapsulated toner compositions usually containing costly pigments and dyes, reference for example the color photocapsule toners of U.S. Pat. Nos. 4,399,209; 4,482,624; 4,483,912 and 4,397,483.

Interfacial polymerization processes are described in British Patent Publication 1,371,179, the disclosure of which is totally incorporated herein by reference, which publication illustrates a method of microencapsulation based on in situ interfacial condensation polymerization. More specifically, this publication discloses a process which permits the encapsulation of organic pesticides by the hydrolysis of polymethylene polyphenyl isocyanate, or toluene diisocyanate monomers. Also, the shell-forming reaction disclosed in the aforementioned publication is initiated by heating the mixture to an elevated temperature at which point the isocyanate monomers are hydrolyzed at the interface to form amines, which then react with unhydrolyzed isocyanate monomers to enable the formation of a polyurea microcapsule wall. Moreover, there is disclosed in U.S. Pat. No. 4,407,922, the disclosure of which is totally incorporated herein by reference, interfacial polymerization processes for pressure sensitive toner compositions comprised of a blend of two immiscible polymers selected from the group consisting of certain polymers as a hard component, and polyoctadecylvinylether-co-maleic anhydride as a soft component.

Other prior art, primarily of background interest, includes U.S. Pat. Nos. 4,254,201; 4,465,755 and Japanese Patent Publication 58-100857. The Japanese publication discloses a capsule toner with high mechanical strength, which is comprised of a core material including a display recording material, a binder, and an outer shell, which outer shell is preferably comprised of a polyurea resin. In the '201 patent, there are disclosed encapsulated electrostatographic toners wherein the shell material comprises at least one resin selected from polyurethane resins, a polyurea resin, or a polyamide resin. In addition, the '755 patent discloses a pressure fixable toner comprising encapsulated particles containing a curing agent, and wherein the shell is comprised of a polyurethane, a polyurea, or a polythiourethane. Moreover, in the '201 patent there are illustrated pressure sensitive adhesive toners comprised of clustered encapsulated porous particles, which toners are prepared by spray drying an aqueous dispersion of the granules containing an encapsulated material.

Also, there are illustrated in U.S. Pat. No. 4,280,833 encapsulated materials prepared by interfacial polymerization in aqueous herbicidal compositions. More specifically, as indicated in column 4, beginning at line 9, there is disclosed a process for encapsulating the water immiscible material within the shell of the polyurea, a water immiscible organic phase which consists of a water immiscible material, that is the material to be encapsulated, and polymethyl polyphenyl isocyanate is added to the aqueous phase with agitation to form a dispersion of small droplets of the water immiscible phase within the aqueous phase; and thereafter, a polyfunctional amine is added with continuous agitation to the organic aqueous dispersion, reference column 4, lines 15 to 27. Also of interest is the disclosure in column 5, line 50, wherein the amine selected can be diethylene triamine, and the core material can be any liquid, oil, meltable solid or solvent soluble material, reference column 4, line 30. A similar teaching is present in U.S. Pat. No. 4,417,916.

In U.S. Pat. No. 4,599,271, the disclosure of which is totally incorporated herein by reference, there are illustrated microcapsules obtained by mixing organic materials in water emulsions at reaction parameters that permit the emulsified organic droplets of each emulsion to collide with one another, reference the disclosure in column 4, lines 5 to 35. Examples of polymeric shells are illustrated, for example, in column 5, beginning at line 40, and include isocyanate compounds such as toluene diisocyanate and polymethylene polyphenyl isocyanates. Further, in column 6, at line 54, it is indicated that the microcapsules disclosed are not limited to use on carbonless copying systems; rather, the film material could comprise other components including xerographic toners, see column 6, line 54.

In U.S. Pat. No. 4,520,091, the disclosure of which is totally incorporated herein by reference, there is illustrated an encapsulated toner material wherein the shell can be formed by reacting a compound having an isocyanate with a polyamine, reference column 4, lines 30 to 61, and column 5, line 19; and U.S. Pat. No. 3,900,669 illustrating a pressure sensitive recording sheet comprising a microcapsule with polyurea walls, and wherein polymethylene polyphenyl isocyanate can be reacted with a polyamide to produce the shell, see column 4, line 34.

Illustrated in U.S. Pat. No. 4,758,506, the disclosure of which is totally incorporated herein by reference, are single component cold pressure fixable toner compositions, wherein the shell selected can be prepared by an interfacial polymerization process. A similar teaching is present in copending U.S. application Ser. No. 718,676 (now abandoned), the disclosure of which is totally incorporated herein by reference. In the aforementioned application, the core can be comprised of magnetite and a polyisobutylene of a specific molecular weight encapsulated in a polymeric shell material generated by an interfacial polymerization process. Further in copending U.S. application Ser. No. 402,306, the disclosure of which is totally incorporated herein by reference, there are illustrated encapsulated toners with a core comprised of a polymer binder, pigment or dye; and thereover a polymeric shell, which contains a soft and flexible component, permitting, for example, proper packing of shell materials resulting in the formation of a high density shell structure, which can effectively contain the core binder and prevent its loss through diffusion and leaching process. The soft and flexible component in one embodiment is comprised of a polyether segment. Specifically, in one embodiment there is disclosed in the aforementioned copending application encapsulated toners comprised of a core containing a polymer binder, pigment or dye particles, and thereover a shell preferably obtained by interfacial polymerization, which shell has incorporated therein a polyether structural moiety. Another embodiment of the copending application is directed to encapsulated toners comprised of a core of resin binder, pigment dye or mixtures thereof, and a polymeric shell of a polyether incorporated polymer, such as a poly(ether urea), a poly(ether amide), a poly(ether ester), a poly(ether urethane), mixtures thereof, and the like. The aforementioned toners can be prepared by an interfacial/free radical polymerization process involving dispersing a mixture of core monomers, colorants, free-radical initiator, and one or more water-immiscible shell precursors into microdroplets in an aqueous medium containing a stabilizer. One of the shell precursors in this organic phase is a polyether-containing monomers or prepolymers. The nature and concentration of the stabilizer employed in the generation of stabilized microdroplets depend mainly, for example, on the toner components, the viscosity of the mixture, as well as on the desired toner particle size. The shell forming interfacial polymerization can be effected by addition of a water soluble shell monomer into the reaction medium. The water soluble shell monomer in the aqueous phase reacts with the water immiscible shell precursors in the organic phase at the microdroplet/water interface resulting in the formation of a microcapsule shell around the microdroplet. The formation of core binder from the core monomers within the newly formed microcapsule is subsequently initiated by heating, thus completing the formation of an encapsulated toner. In embodiments thereof (1) the compositions of the present invention utilize a very polar shell polymer wherein polar functional groups, such as hydroxy functions, are all present in the shell polymer structure; (2) the toner compositions of the present invention employ a polar shell which inhibits core resin leaching or diffusion primarily because of its incompatibility with the relatively nonpolar core resin; and (3) the toner compositions of the present invention also provide images of high abrasion resistance, presumably because of the strong interactions of the polar shell material with paper.

Accordingly, there is a need for encapsulated toner compositions with many, and in some embodiments substantially all the advantages illustrated herein. More specifically, there is a need for encapsulated toners with shells that eliminate or minimize the loss of core components such as the core resin. Also, there is a need for encapsulated toners wherein images with excellent resolution and superior fix are obtained. Moreover, there is a need for encapsulated toners, including colored toners wherein image ghosting and toner offsetting and the like are avoided or minimized. Additionally, there is a need for encapsulated toners, including colored toners with, in some instances, excellent surface release characteristics to enhance toner transfer efficiency in the transfix ionographic imaging systems. Furthermore, there is a need for encapsulated toners, including colored toners, which exhibit no toner agglomeration thus providing a long toner shelf life exceeding in embodiments, for example, one to two years. Also, there is a need for encapsulated toners that have been surface treated with additives, such as carbon blacks, graphite or the like, to render them conductive to a volume resistivity level of preferably from about $1\times10^3$ to $1\times10^8$ ohm-cm, and to enable their use in single component inductive development systems. Further, there is a need for encapsulated toners wherein surface additives, such as metal salts or metal salts of fatty acids and the like, are utilized to primarily assist in toner surface release properties. There is also a need for processes for the preparation of encapsulated toners with the advantages described hereinbefore. There is also a need for interfacial polymerization microencapsulation processes for black and colored encapsulated toner compositions, wherein the core contains a colorant or colorants, and a core resin derived from in situ free radical polymerization of an addition-type monomer or monomers, which core is encapsulated in a polar condensation polymeric shell. Furthermore, there is a need for toners and improved processes thereof that will enable the preparation of pressure fixable encapsulated toner compositions whose properties such as shell strength, nature of core resin, the core resin molecular weight and molecular weight distribution can be desirably controlled. Moreover, there is a need for toner compositions which provide high image fix levels as well as excellent abrasion and crease resistance characteristics.

SUMMARY OF THE INVENTION

It is a feature of the present invention to provide encapsulated toner compositions with many of the advantages illustrated herein.

It is also a feature of the present invention to provide encapsulated toner compositions which provide desirable toner properties such as nonagglomerating, nonghosting, high image fix, excellent image abrasion, crease and rub resistance, and excellent image permanence characteristics.

In another feature of the present invention there are provided encapsulated toner compositions comprised of a core of resin binder, colorants such as color pigments or dyes, or mixtures thereof, and thereover a microcapsule shell prepared, for example, by interfacial polymerization which shell is comprised of a polar condensation polymer which is capable of, for example, eliminating or suppressing the undesirable leaching or bleeding of core binder.

Another feature of the present invention is the provision of encapsulated toners wherein image ghosting is eliminated in some embodiments, or minimized in other embodiments.

Further, another feature of the present invention is the provision of encapsulated toners wherein toner agglomeration is eliminated in some embodiments, or minimized in other embodiments.

Also, another feature of the present invention is the provision of encapsulated toners wherein core component leaching or loss is eliminated in some embodiments, or minimized in other embodiments.

Moreover, another feature of the present invention is the provision of encapsulated toners wherein toner offsetting is eliminated in some embodiments, or minimized in other embodiments.

Additionally, another feature of the present invention is the provision of encapsulated toners with extended shelf life.

Also, another feature of the present invention is the provision of colored, that is other than black encapsulated toners.

It is another feature of the present invention to provide encapsulated toners wherein the contamination of the imaging member, such as an electroreceptor, is eliminated or minimized.

Another feature of the present invention is the provision of encapsulated toners that can be selected for imaging processes, especially processes wherein pressure fixing is selected.

In another feature of the present invention there are provided simple and economical preparative processes for black and colored toner compositions involving an interfacial shell forming polymerization and an in situ free radical core resin forming polymerization whereby the shell formation, core resin formation, and the resulting toner material properties, can be independently and desirably controlled.

Another feature of the present invention resides in the provision of simple and economical processes for black and colored pressure fixable toner compositions with durable, pressure rupturable shells.

Moreover, in a further feature of the present invention there are provided processes for pressure fixable toner compositions wherein the core resins thereof are obtained via in situ free radical polymerization of addition-type monomers, which monomers also serve as a diluting vehicle and as a reaction medium for polymerization, thus eliminating the need for undesirable organic solvents in the process.

Another feature of the present invention resides in the provision of processes for generating toner compositions with a relatively high bulk density of, for example, about 0.8 to about 1.4.

These and other features of the present invention can be accomplished by the provision of toners and, more specifically, encapsulated toners. In one embodiment of the present invention, there are provided encapsulated toners with a core comprised of a polymer binder, pigment or dye; and thereover a polar condensation polymer shell derived from the reaction of a glycidyl functionalized reagent or component, and a polyisocyanate with a polyamine, which shell is capable of effectively containing the core binder, with the result that the loss of core binder through diffusion and leaching through the shell is eliminated or substantially minimized. The shell of the present invention may also contain a soft and flexible component which in one embodiment is comprised of a polyether moiety present in the polyisocyanate or the glycidyl functionalized reagents. In one embodiment, there are provided in accordance with the present invention encapsulated toners comprised of a core containing a polymer binder, pigment or dye particles, and thereover a polar polymer shell obtained by interfacial polymerization of a glycidyl functionalized reagent and a polyisocyanate with a polyamine, which shell has incorporated therein a polyether structural moiety. Another embodiment of the present invention is directed to encapsulated toners comprised of a core of polymer binder, pigment, dye or mixtures thereof, and a polar polymer shell having conductive components, such as carbon black, dispersed therein.

The toners of the present invention can be prepared by an interfacial/free radical polymerization process comprising dispersing a mixture of core monomers, colorants, free radical initiator, and at least two water immiscible shell precursors such as a glycidyl functionalized reagent and a polyisocyanate into microdroplets in an aqueous medium containing an emulsifier or stabilizer. The nature and concentration of the emulsifier or stabilizer employed in the generation of stabilized microdroplets depend mainly, for example, on the toner components, the viscosity of the mixture, the desired toner particle size, and the like. The shell forming interfacial polymerization can be effected by the addition of a water soluble polyamine into the reaction medium. The polyamine from the aqueous phase reacts with the glycidyl functionalized reagent and the polyisocyanate from the microdroplet phase at the microdroplet/water interface resulting in the formation of a polar microcapsule shell around the microdroplet. The formation of core binder from the core monomers within the newly formed microcapsule is subsequently initiated by heating, thus completing the formation of an encapsulated toner of the present invention. In an embodiment, the present invention relates to the provision of a pressure fixable encapsulated toner comprised of a core of an addition polymer binder obtained preferably by in situ free radical polymerization, magnetic pigment such as iron oxide, or magnetite, encapsulated thereover by a polar polymer shell obtained by interfacial polycondensation of a diglycidyl functionalized reagent and a diisocyanate with a diamine, and wherein the properties of the shell can be tailored to certain specifications by, for example, controlling the stoichiometry of shell precursors as well as by adding suitable crosslinking agents such as triisocyanate, triamine, a polyglycidyl functionalized reagent, and the like.

Illustrative examples of core monomers, which are subsequently polymerized within the microcapsule after the shell forming interfacial polymerization, and are present in an effective amount of from, for example, about 10 to about 90 percent by weight, include acrylates, methacrylates, olefins including styrene and its derivatives, such as styrene butadiene, and the like. Specific examples of core monomers which can be selected include methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, dodecyl styrene, methylhexyl styrene, nonyl styrene, tetradecyl styrene, other substantially equivalent addition monomers, and other known addition monomers, reference for example U.S. Pat. No. 4,298,672, the disclosure of which is totally incorporated herein by reference, and mixtures thereof. A plurality of monomers can be selected, for example, it is believed that up to 20 monomers in embodiments of the present invention can be selected.

Various known pigments, present in the core in an effective amount of, for example, from about 2 to about 70 percent by weight, can be selected inclusive of carbon black, magnetites, such as Mobay magnetites MO8029, MO8060; Columbian Mapico Blacks and surface treated magnetites; Pfizer magnetites CB4799, CB5300, CB5600, MCX636; Bayer magnetites Bayferrox 8600, 8610; Northern Pigments magnetites, NP-604, NP-608; Magnox magnetites TMB-100 or TMB-104; and other similar black pigments, including mixtures of these pigments with colored pigments, such as those illustrated herein. As colored pigments there can be selected Heliogen Blue L6900, D6840, D7080, D7020, Pylam Oil Blue and Pylam Oil Yellow, Pigment Blue 1 available from Paul Uhlich & Company, Inc., Pigment Violet 1, Pigment Red 48, Lemon Chrome Yellow DCC 1026, E. D. Toluidine Red and Bon Red C available from Dominion Color Corporation, Ltd., Toronto, Ontario, NOVAperm Yellow FGL, Hostaperm Pink E available from Hoechst, Cinquasia Magenta available from E. I. DuPont de Nemours & Company, and the like. Primary color pigments, that is cyan, magenta and yellow pigments, can be selected for the toner compositions of the present invention. Examples of magenta pigments include for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the microencapsulated toner compositions in various suitable effective amounts. In one embodiment, the pigment particles are present in the toner composition in an amount of from about 2 percent by weight to about 70 percent by weight calculated on the weight of the dry toner.

In one embodiment of the present invention, the microcapsule shells are formed by interfacial copolycondensation of a diglycidyl functionalized reagent and one or more polyisocyanates with a diamine. Generally, the shell polymer comprises from about 5 to about 30 percent by weight of the encapsulated toner composition, and preferably comprises from about 8 percent by weight to about 20 percent by weight of the toner composition. An effective mole fraction of glycidyl functionalized reagent to polyisocyanate employed in the interfacial polycondensation with polyamine generally is, for example, from about 0.2 to about 1.0, and preferably from about 0.5 to about 0.9. In general, a slight excess of polyamine of about 1 to about 15 mole percent is utilized. Illustrative examples of glycidyl functionalized reagents that can be selected for the toner compositions of the present invention include ethanediol diglycidyl ether, propanediol diglycidyl ether, butanediol diglycidyl ether, pentanediol diglycidyl ether, hexanediol diglycidyl ether, 2-methylpropanediol diglycidyl ether, 2-methylbutanediol diglycidyl ether, 2,2-dimethylpropanediol diglycidyl ether, 1,4-dimethylenecylcohexanediol diglycidyl ether, 2,2-dimethylpentanediol diglycidyl ether, bisphenol A diglycidyl ether, bisphenol F diglycidyl ether, bisphenol Z diglycidyl ether, xylenediol diglycidyl ether, ethylene glycol diglycidyl ether, diethylene glycol diglycidyl ether, triethylene glycol diglycidyl ether, epichlorohydrinbutanediol epoxy resins, epichlorohydrin-2,2-dimethylpropanediol epoxy resins, epichlorohydrin-tetraphenylol ethane epoxy resins, epichlorohydrinresorcine epoxy resins, epichlorohydrin-bisphenol A epoxy resins, epichlorohydrin-bisphenol F epoxy resins, epichlorohydrin-bisphenol Z epoxy resins, epichlorohydrin-tetrahydroxyphenylmethane epoxy resins, epichlorohydrin-polyglycol epoxy resins, epichlorohydrin-glycerine triether epoxy resins, and epichlorohydrin-halogenated bisphenol epoxy resins, and the like. Illustrative examples of polyisocyantes include benzene diisocyanate, toluene diisocyanate, diphenylmethane diisocyanate, 1,6-hexamethylene diisocyanate, bis(4-isocyanatocyclohexyl)-methane, MODUR CB-60, MONDUR CB-75, MONDUR MR, MONDUR MRS 10, PAPI 27, PAPI 135, Isonate 143 L, Isonate 181, Isonate 125M, Isonate 191, and Isonate 240, and the like. Illustrative examples of suitable polyamines include, for example, ethylenediamine, trimethyelenediamine, tetramethylenediamine, pentamethylenediamine, hexamethylenediamine, heptamethyelenediamine, octamethylenediamine, methylpentamethylenediamine, phenylenediamine, 2-hydroxy trimethylenediamine, diethylenetriamine, triethylenetetraamine, tetraethylenepentaamine, xylylenediamine, bis(hexamethylene)triamine, tris-(aminoethyl)amine, 4,4'-methylene bis(cyclohexylamine), bis(aminopropyl)ethylenediamine, bis(aminomethyl)cyclohexane, 1,5-diamino-2-methylpentane, piperazine, 2-methylpiperazine, 2,5-dimethylpiperazine, 1,4-bis(3-aminopropyl)piperazine, 2,5-dimethylpentamethylene diamine, and the like. During the aforementioned interfacial polycondensation to form the shell, the temperature is usually maintained in embodiments at from about 15° C. to about 55° C., and preferably from about 20° C. to about 30° C. Also, generally the reaction time is from about 5 minutes to about 5 hours, and preferably from about 20 minutes to about 90 minutes. Other temperatures and times can be selected, and further other polyisocyanates and polyamines not specifically mentioned as well as mixtures thereof may be selected.

Another embodiment of the present invention relates to encapsulated toners with the aforementioned shell and wherein the toner includes thereon an electroconductive material obtained from a water based dispersion of said electroconductive material in a polymeric binder. The shell is comprised of the components illustrated herein wherein for example, the polyisocyanate is selected from the group of polyether isocyanates consisting of Uniroyal Chemical's polyether Vibrathanes B-604, B-614, B-635, B-843, and Mobay Chemical Corporation's polyether isocyanate prepolymers E-21 or E-21A, XP-743, XP-744, and the like; the polyamine is selected, for example, from the group consisting of ethylenediamine, trimethyelenediamine, tetramethylenediamine, pentamethylenediamine, hexamethylenediamine, heptamethyelenediamine, octamethylenediamine, methylpentamethylenediamine, phenylenediamine, 2-hydroxy trimethylenediamine, diethylenetriamine, triethylenetetraamine, tetraethylenepentaamine, xylylenediamine, bis(hexamethylene)triamine, tris-(aminoethyl)amine, 4,4'-methylene bis(cyclohexylamine), bis(aminopropyl)ethylenediamine, bis(aminomethyl)cyclohexane, 1,5-diamino-2-methylpentane, piperazine, 2-methylpiperazine, 2,5-dimethylpiperazine, 1,4-bis(3-aminopropyl)piperazine, 2,5-dimethylpentamethylene diamine, and the like; and a carbon black, graphite and the like, conductive component. Generally, the polyether isocyanate is selected in an amount of about 1 percent to 100 percent by weight of the total quantity of polyisocyanates used, and preferably in an amount of about 2 percent to about 20 percent by weight of the total quantity of polyisocyanates. Moreover, the polyether isocyanate can preferably have an NCO content of from about 1 percent to about 30 percent, and more preferably from about 5 percent to about 20 percent by weight.

Other isocyanates may be selected for reaction with the polyamine to enable formation of the shell by interfacial polymerization, reference for example U.S. Pat. No. 4,612,272 and U.K. Patents 2,107,670 and 2,135,469, the disclosures of which are totally incorporated herein by reference.

As one shell material, there is selected the interfacial polycondensation product of a mixture of bisphenol A diglycidyl ether and Isonate 143L with 1,4-bis(3-aminopropyl)piperazine, with the mole fraction of bisphenol A diglycidyl ether to isonate 143L being in the range of about 0.50 to about 0.90, and preferably of about 0.65 to about 0.85. For the preparation of the shell material, 1,4-bis(3-aminopropyl)piperazine or 2-methylpentamethylenediamine is employed in a slight molar excess of about 5 to 10 percent.

Interfacial processes selected for the shell formation of the toners of the present invention are as illustrated, for example, in U.S. Pat. Nos. 4,000,087 and 4,307,169, the disclosures of which are totally incorporated herein by reference.

Surface additives that can be selected for the toners of the present invention including, for example, metal salts, metal salts of fatty acids, colloidal silicas, mixtures thereof and the like, which additives are usually present in an amount of from about 0.1 to about 1 weight percent, reference U.S. Pat. No. 3,590,000; 3,720,617; 3,655,374 and 3,983,045, the disclosures of which are totally incorporated herein by reference. Preferred additives include zinc stearate and Aerosil R972.

The toner compositions of the present invention can be prepared by a number of different processes as indicated herein including the interfacial/free radical polymerization process comprising mixing or blending of a core monomer or monomers, a mixture of glycidyl functionalized reagent and polyisocyanate, free radical initiator, and colorants; dispersing this mixture of organic materials and colorants by high shear blending into stabilized microdroplets of specific droplet size and size distribution in an aqueous medium with the aid of suitable stabilizers or emulsifying agents wherein the average volume microdroplet diameter generally ranges from about 5 microns to about 30 microns with the average volume droplet size dispersity generally being less than about 1.4 as inferred from the Coulter Counter measurements of the microcapsule particles after encapsulation; subsequently subjecting the aforementioned dispersion to a shell forming interfacial polycondensation by adding a water miscible polyamine; and thereafter, initiating the heat induced free radical polymerization for the formation of core binder within the newly formed microcapsules. The shell forming interfacial polycondensation is generally executed at ambient temperature, but elevated temperatures may also be employed depending on the nature and functionality of the shell components used. For the core binder forming free radical polymerization, it is generally accomplished at temperatures from ambient temperature to about 100° C., and preferably from ambient temperature to about 90° C. In addition, more than one initiator may be utilized to enhance the polymerization conversion, and to generate the desired molecular weight and molecular weight distribution.

Illustrative examples of free radical initiators selected include azo compounds such as 2-2'azodimethylvaleronitrile, 2-2'azoisobutyronitrile, azobiscyclohexanenitrile, 2-methylbutyronitrile, or mixtures thereof, and other similar known compounds, with the quantity of initiator(s) preferably being from about 0.5 percent to about 10 percent by weight of that of core monomer(s). Stabilizers or emulsifying agents selected include water soluble polymeric surfactants such as poly(vinyl alcohols), partially hydrolyzed poly(vinyl alcohols), hydroxypropyl cellulose, hydroxyethyl methyl cellulose, methyl cellulose, with a stabilizer to water ratio of from about 0.05 to about 0.75 for example.

The encapsulated toner compositions of the present invention in embodiments thereof are mechanically and thermally stable and possess acceptable shelf life stability. For example, the encapsulated toners of the present invention in a number of embodiments do not suffer from premature rupture, and are nonblocking and nonagglomerating at temperatures of up to 70° C. The shell materials of the present invention are robust and display a low degree of shell permeability to the core components, and in particular to the core binder resins. No leaching or bleeding of core components occur at storage for an extended period of time of over one to two years in embodiments thereof. In addition, the shell polymer of the present invention, with the aid of surface additives, also provide excellent surface release as well as excellent powder flow properties to the resultant toner in embodiments thereof. The aforementioned toner physical properties enable, for example, high image transfer efficiency and prevent image ghosting and offset during image development.

Also, the toner compositions can be rendered conductive with, for example, a volume resistivity value of from about $1\times10^3$ ohm-cm to about $1\times10^8$ ohm-cm by adding to the toner surface thereof components such as carbon blacks, graphite, and other conductive organometallic compounds. The aforementioned conductive toner compositions of the present invention are particularly useful for the inductive development of electrostatic images. More specifically, in accordance with the present invention, there is provided a method for developing electrostatic images which comprises forming latent electrostatic images on a hard dielectric surface of an image cylinder by depositing ions from a corona source; developing the images with the single component magnetic toner composition illustrated herein; followed by simultaneous transferring and fixing by pressure onto paper with a toner transfer efficiency greater than 95 percent, and in many instances over 99 percent. The transfix pressure utilized for image fixing is generally less than 1,000 psi to about 4,000 psi, however, preferably the transfix pressure is 2,000 psi in embodiments help to eliminate or alleviate the paper calendering and high image gloss problems. Examples of pressure fixing processes and systems that can be selected include those commerically available from Xerox Corporation, Delphax, Hitachi, Cybernet, and others.

Further, the present invention is directed to methods for the development of images by, for example, forming by ion deposition on an electroreceptor, such as a polymer impregnated anodized aluminum oxide, a latent image, developing this image with the pressure fixable encapsulated toner compositions of the present invention, and subsequently simultaneously transferring and fixing the image to a suitable substrate such as paper.

For two component developers, carrier particles including steel, iron powder, ferrites, copper zinc ferrites, and the like with or without coatings, at an effective coating weight of from, for example, 0.1 to about 5 weight percent, coating can be admixed with the encapsulated toners, especially the insulative encapsulated toners of the present invention, reference for example the carriers illustrated in U.S. Pat. Nos. 4,937,166 and 4,935,326; U.S. Pat. Nos. 4,560,635; 4,298,672; 3,839,029; 3,847,604; 3,849,182; 3,914,181; 3,929,657 and 4,042,518, the disclosures of which are totally incorporated herein by reference. Specific coating examples include styrene terpolymers, fluoropolymers, trifluorochloroethylene/vinyl acetate copolymers, trifluorochloroethylene copolymers, mixtures of polyvinylidiene fluoride and polymethylacrylate (60/40), polymethacrylates, and the like.

The following examples are being submitted to further define various species of the present invention. These examples are intended to be illustrative only and are not intended to limit the scope of the present invention. A Coulter Counter was utilized to determine the toner's volume average particle diameter.

EXAMPLE I

A 23.1 micron (average volume diameter) pressure fixable encapsulated toner with a polymer shell derived from polycondensation of bisphenol A diglycidyl ether, Araldite GY 306, with 1,4-bis(3-aminopropyl)piperazine and an isocyanate was prepared as follows:

In a 2 liter Nalgene container were discharged lauryl methacrylate (113 grams), Vazo-52 initiator (3.7 grams), Vazo-64 initiator (3.7 grams), Araldite GY 306 (46.7 grams, from CIBA-GEIGY), Isonate 143L (4.3 grams), Epoxy Resin 0510 (2.0 grams, from CIBA-GEIGY), and dichloromethane (20 milliliters). The mixture was blended with an IKA polytron at 4,000 rpm for 30 seconds, followed by addition of Bayferrox 8610 magnetite (300 grams). The mixture was blended again at 8,000 rpm for 3 minutes before homogenizing in 1 liter of 0.06 percent aqueous poly(vinyl alcohol) (88 percent hydrolyzed, Mw=96,000) solution at 9,000 rpm for 2 minutes. The resulting suspension was transferred to a 2 liter kettle and mechanically stirred at room temperature after which an aqueous solution of 37 milliliters of 1,4-bis(3-aminopropyl)piperazine in 80 milliliters of water was added. After 1.5 hours, the mixture was heated to 90° C. over a period of 1 hour and then held at this temperature for 5 hours. The resulting mixture was cooled to room temperature and the supernatant was decanted off. The residue was repeatedly washed with water until the supernatant was clear. The resulting encapsulated particles were transferred to a 2-liter beaker and diluted with water to a total volume of 1.8 liter. A dispersion of Aquadag graphite E (15.5 grams, from Acheson Colloids) in water (100 milliliters) was then added, and the mixture was spray dried in a Yamato Spray Dryer at an air inlet temperature of 160° C., and an air outlet temperature of 80° C. The air flow was retained at 0.75 $m^3$/minute, while the atomizing air pressure was retained at 1.0 kilogram/$cm^2$. The collected dry encapsulated particles (315 grams) were screened through a 63 micron sieve; the toner's volume average particle diameter, as measured on a 256 channel Coulter Counter, was 23.1 microns with a volume average particle size dispersity of 1.27.

Two hundred and forty (240) grams of the above encapsulated particles were dry blended using a Greey blender, first with 0.96 gram of carbon black (Black Pearls 2000) for 2 minutes at 3,500 RPM, and then with 3.6 grams of zinc stearate for an additional 10 minutes at 3,000 RPM, to provide an encapsulated toner with a volume resistivity of $1\times10^6$ ohm-cm.

The pressure fixing ionographic printer selected for the testing of the toner compositions was the Delphax S-6000 TM printer. The developed images were transfixed at a pressure of 2,000 psi. Print quality was evaluated from a checkerboard print pattern. The image optical density was measured using a standard integrating densitometer. Image fix was measured by the standardized tape pull method wherein a tape was pressed with a uniform reproducible standard pressure against an image and then removed. The image fix level was expressed as a percentage of the retained image optical density after the tape test relative to the original image optical density. Image ghosting was evaluated qualitatively for over 2,000 prints. Toner shell integrity was judged qualitatively by observing any crushed or agglomerated toner on the hopper screen through which toner was fed to the machine magnetic roller. If crushed toner was found to adhere to and clog some of the screen openings after 2,000 copies, it was judged to have a premature toner rupture problem.

For this toner, the image fix level was 93 percent with no image ghosting, and no toner agglomeration in the development housing for 2,000 prints. Furthermore, this toner did not display agglomeration on standing for one day, and no toner blocking was observed at 55° C. for 48 hours.

EXAMPLE II

A 15.3 micron encapsulated toner with a polymer shell derived from polycondensation of bisphenol A diglycidyl ether, Araldite GY 306 and Isonate 143L with 1,4-bis(3-aminopropyl)piperazine, and a core of poly(lauryl methacrylate) and Bayferrox 8610 magnetite was prepared as follows:

In a 2 liter Nalgene container were discharged lauryl methacrylate (113 grams), Vazo-52 initiator (3.7 grams), Vazo-64 initiator (3.7 grams), Araldite GY 306 (8.4 grams, from CIBA-GEIGY), Isonate 143L (39.0 grams) and dichloromethane (20 milliliters). The mixture was blended with an IKA polytron at 4,000 rpm for 30 seconds, followed by addition of Bayferrox 8610 magnetite (300 grams). The mixture was blended again at 8,000 rpm for 3 minutes, before homogenizing in 1 liter of 0.08 percent aqueous poly(vinyl alcohol) (88 percent hydrolyzed, Mw=96,000) solution at 9,000 rpm for 2 minutes. The resulting suspension was transferred to a 2 liter kettle and mechanically stirred at room temperature after which an aqueous solution of 37 milliliters of 1,4-bis(3-aminopropyl)piperazine in 80 milliliters of water was added. After 1.5 hours, the mixture was heated to 90° C. over a period of 1 hour, and then held at this temperature for 5 hours. The resulting mixture was cooled to room temperature and the supernatant was decanted off. The residue was repeatedly washed with water until the supernatant was clear. The resulting encapsulated particles were transferred to a 2-liter beaker and diluted with water to a total volume of 1.8 liter. A dispersion of Aquadag graphite E (29.2 grams, from Acheson Colloids) in water (100 milliliters) was then added, and the mixture was spray dried in a Yamato Spray Dryer at an air inlet temperature of 160° C. and an air outlet temperature of 80° C. The air flow was retained at 0.75 $m^3$/minute, while the atomizing air pressure was retained at 1.0 kilogram/$cm^2$. The collected dry encapsulated particles (310 grams) were screened through a 63 micron sieve; the toner's volume average particle diameter, as measured on a 256 channel Coulter Counter, was 15.3 microns with a volume average particle size dispersity of 1.31.

Two hundred forty (240) grams of the above encapsulated particles were dry blended using a Greey blender, first with 0.96 gram of carbon black (Black Pearls 2000) for 2 minutes at 3,500 RPM, and then with 3.6 grams of zinc stearate for an additional 10 minutes at 3,000 RPM, to provide an encapsulated toner with a volume resistivity of $3.5\times10^6$ ohm-cm.

Machine testing of this toner was accomplished in accordance with the procedure of Example I. For this toner, the image fix level was 86 percent with no image ghosting, and no toner agglomeration in the development housing for 2,000 prints. Furthermore, this toner did not display agglomeration on standing, and no toner blocking was observed at 55° C. for 72 hours.

EXAMPLE III

A 14.6 micron encapsulated toner comprising a polymer shell derived from polycondensation of phenol A diglycidyl ether and Isonate 143L with 1,4-bis(3-aminopropyl)piperazine, and a core of poly(lauryl methacrylate) and Bayferrox 8610 magnetite was prepared as follows:

In a 2 liter Nalgene container were discharged lauryl methacrylate (113 grams), Vazo-52 initiator (3.7 grams), Vazo-64 initiator (3.7 grams), Araldite GY 306 (24.6 grams, from CIBA-GEIGY), Isonate 143L (23.0 grams) and dichloromethane (20 milliliters). The mixture was blended with an IKA polytron at 4,000 rpm for 30 seconds, followed by addition of Bayferrox 8610 magnetite (300 grams). The mixture was blended again at 8,000 rpm for 3 minutes before homogenizing in 1 liter of 0.12 percent aqueous poly(vinyl alcohol) (88 percent hydrolyzed, Mw=96,000) solution at 9,000 rpm for 2 minutes. The resulting suspension was transferred to a 2 liter kettle and mechanically stirred at room temperature after which an aqueous solution of 37 milliliters of 1,4-bis(3-aminopropyl)piperazine in 80 milliliters of water was added. After 1.5 hours, the mixture was heated to 90° C. over a period of 1 hour, and then held at this temperature for 5 hours. The resulting mixture was cooled to room temperature and the supernatant was decanted off. The residue was repeatedly washed with water until the supernatant was clear. The resulting encapsulated particles were transferred to a 2 liter beaker and diluted with water to a total volume of 1.8 liter. A dispersion of Aquadag graphite E (30.7 grams, from Acheson Colloids) and water (100 milliliters) was then added, and the mixture was spray dried in a Yamato Spray Dryer at an air inlet temperature of 160° C. and an air outlet temperature of 80° C. The air flow was retained at 0.75 $m^3$/minute, while the atomizing air pressure was retained at 1.0 kilogram/$cm^2$. The collected dry encapsulated particles (320 grams) were screened through a 63 micron sieve; the toner's volume average particle diameter, as measured on a 256 channel Coulter Counter, was 14.6 microns with a volume average particle size dispersity of 1.33.

Two hundred and forty (240) grams of the above encapsulated particles were dry blended using a Greey blender, first with 0.96 gram of carbon black (Black Pearls 2000) for 2 minutes at 3,500 RPM, and then with 3.6 grams of zinc stearate for an additional 10 minutes at 3,000 RPM, to provide an encapsulated toner with a volume resistivity of $1.0\times10^5$ ohm-cm.

Machine testing of this toner was accomplished in accordance with the procedure of Example I. For this toner, the image fix level was 89 percent with no image ghosting, and no toner agglomeration in the development housing for 2,000 prints. Furthermore, this toner did not display agglomeration on standing, and no toner blocking was observed at 55° C. for 48 hours.

EXAMPLE IV

A 14.6 micron encapsulated toner comprising a polymer shell derived from butanediol diglycidyl ether, Araldite RD-2 and Isonate 143L with 2-methylpentamethylenediamine, and a core of poly(lauryl methacrylate) and Bayferrox 8610 magnetite was prepared as follows.

In a 2 liter Nalgene container were discharged lauryl methacrylate (113 grams), Vazo-52 initiator (3.7 grams), Vazo-64 initiator (3.7 grams), Araldite RD-2 (9.0 grams, from CIBA-GEIGY), Isonate 143L (39.0 grams) and dichloromethane (20 milliliters). The mixture was blended with an IKA polytron at 4,000 rpm for 30 seconds, followed by addition of Bayferrox 8610 magnetite (300 grams). The mixture was blended again at 8,000 rpm for 3 minutes before homogenizing in 1 liter of 0.10 percent aqueous poly(vinyl alcohol) (88 percent hydrolyzed, Mw=96,000) solution at 9,000 rpm for 2 minutes. The resulting suspension was transferred to a 2 liter kettle and mechanically stirred at room temperature after which an aqueous solution of 24 milliliters of 2-methylpentamethylenediamine in 80 milliliters of water was added. After 1.5 hours, the mixture was heated to 90° C. over a period of 1 hour, and then held at this temperature for 5 hours. The resulting mixture was cooled to room temperature and the supernatant was decanted off. The residue was repeatedly washed with water until the supernatant was clear. The resulting encapsulated particles were transferred to a 2 liter beaker and diluted with water to a total volume of 1.8 liter. A dispersion of Aquadag graphite E (30.7 grams, from Acheson Colloids) in water (100 milliliters) was then added, and the mixture was spray dried in a Yamato Spray Dryer at an air inlet temperature of 160° C. and an air outlet temperature of 80° C. The air flow was retained at 0.75 $m^3$/minute, while the atomizing air pressure was retained at 1.0 kilogram/$cm^2$. The collected dry encapsulated particles (320 grams) were screened through a 63 micron sieve; the toner's volume average particle diameter, as measured on a 256 channel Coulter Counter, was 14.6 microns with a volume average particle size dispersity of 1.29.

Two hundred and forty (240) grams of the above encapsulated particles were dry blended using a Greey blender, first with 0.96 gram of carbon black (Black Pearls 2000) for 2 minutes at 3,500 RPM, and then with 3.6 grams of zinc stearate for an additional 10 minutes at 3,000 RPM to provide an encapsulated toner with a volume resistivity of $4.5\times10^6$ ohm-cm.

Machine testing of the toner was accomplished in accordance with the procedure of Example I, and substantially similar results were obtained.

EXAMPLE V

A 15.6 micron encapsulated toner comprising a polymer shell derived from butanediol diglycidyl ether and Isonate 143L with 1,4-bis(3-aminopropyl)piperazine, and a core of lauryl methacrylate-stearyl methacrylate copolymer and Bayferrox 8610 magnetite was prepared as follows:

The toner was prepared in accordance with the procedure of Example I with the exceptions that a mixture of n-lauryl methacrylate (56.5 grams) and stearyl methacrylate (56.5 grams) was employed in place of lauryl methacrylate. In addition, Araldite RD-2 was utilized instead of Araldite GY 306. A total of 315 grams of dry toner was obtained. The toner's volume average particle diameter, as measured on a 256 channel Coulter Counter, was 15.6 microns with a volume average particle size dispersity of 1.34. Machine testing of the toner was accomplished in accordance with the procedure of Example I, and substantially similar results were obtained.

EXAMPLE VI

A 15.2 micron encapsulated toner with a polymer shell derived from the polycondensation of epichlorohydrin-bisphenol A epoxy resin and Isonate 143L with 2-methylpentamethylenediamine, and a core of poly(lauryl methacrylate) and Bayferrox 8610 magnetite was prepared as follows:

The toner was prepared in accordance with the procedure of Example IV except that 11.5 grams of Araldite 6010 (from CIBA-GEIGY) was utilized in place of 9.0 grams of Araldite RD-2. A total of 318 grams of dry encapsulated toner was obtained. The toner's volume average particle diameter, as measured on a 256 channel Coulter Counter, was 15.2 microns with a volume average particle size dispersity of 1.31. Machine testing of the toner was accomplished in accordance with the procedure of Example I, and substantially similar results were obtained.

EXAMPLE VII

A 17.1 micron encapsulated toner with a polymer shell derived from polycondensation of bisphenol A diglycidyl ether and Isonate 143L with 2-methylpentamethylenediamine, and a core of poly(lauryl methacrylate) and Northern Pigments NP-608 magnetite was prepared as follows:

The toner was prepared in accordance with the procedure of Example II except that 24 milliliters of 2-methylpentamethylenediamine and 280 grams of Northern Pigments NP-608 magnetite were utilized in place of 37 milliliters of 1,4-bis(3-aminopropyl)piperazine and 300 grams of Bayferrox 8610 magnetite. A total of 304 grams of dry encapsulated toner was obtained. The toner's volume average particle diameter, as measured on a 256 channel Coulter Counter, was 17.1 microns with a volume average particle size dispersity of 1.33. Machine testing of the toner was accomplished in accordance with the procedure of Example I, and substantially similar results were obtained.

EXAMPLE VIII

A 15.7 micron encapsulated toner with a polymer shell derived from polycondensation of neopentylglycol diglycidyl ether and Isonate 143L with 1,4-bis(3-aminopropyl)piperazine, and a core of poly(lauryl methacrylate) and Mapico Black magnetite was prepared as follows:

The toner was prepared in accordance with the procedure of Example II except that neopentylglycol diglycidyl ether and Mapico Black magnetite were employed instead of, respectively, Araldite GY 306 and Bayferrox 8610 magnetite. A total of 321 grams of dry encapsulated toner was obtained. The toner's volume average particle diameter, as measured on a 256 channel Coulter Counter, was 15.7 microns with a volume average particle size dispersity of 1.29. Machine testing of the toner was accomplished in accordance with the procedure of Example I, and substantially similar results were obtained.

EXAMPLE IX

A 16.5 micron encapsulated toner with a polymer shell derived from polycondensation of neopentylglycol diglycidyl ether and Isonate 143L with 1,4-bis(3-aminopropyl)piperazine, and a core of poly(lauryl methacrylate) and Magnox TMB-100 magnetite was prepared as follows:

The toner was prepared in accordance with the procedure of Example VIII except that Magnox TMB-100 magnetite was utilized instead of Mapico Black magnetite. The yield of dry encapsulated toner was 315 grams. The toner's volume average particle diameter, as measured on a 256 channel Coulter Counter, was 16.5 microns with a volume average particle size dispersity of 1.35. Machine testing of the toner was accomplished in accordance with the procedure of Example I, and substantially similar results were obtained.

EXAMPLE X

An 15.1 micron encapsulated toner comprising of a polymer shell derived from polycondensation of phenol A diglycidyl ether and Isonate 143L with 2-methylpentamethylenediamine, and a core of poly(lauryl methacrylate) and Northern Pigments NP-604 magnetite was prepared as follows:

The toner was prepared in accordance with the procedure of Example III using 24 milliliters of 2-methylpentamethylenediamine and Northern Pigments NP-604 magnetite instead of 37 milliliters of 1,4-bis(3-aminopropyl)piperazine and Bayferrox 8610 magnetite. The yield of dry encapsulated toner was 317 grams; the toner's volume average particle diameter, as measured on a 256 channel Coulter Counter, was 16.5 microns with a volume average particle size dispersity of 1.35. Machine testing of the toner was accomplished in accordance with the procedure of Example I, and substantially similar results were obtained.

Other modifications of the present invention may occur to those skilled in the art subsequent to a review of the present application, and these modifications, including equivalents thereof, are intended to be included within the scope of the present invention.

What is claimed is:

1. An encapsulated toner composition comprised of a core comprised of a polymer binder, pigment, and a polymeric shell derived from the polycondensation of a glycidyl-functionalized reagent and a polyisocyanate with a polyamine.

2. A toner in accordance with claim 1 wherein the glycidyl functionalized reagent is a diglycidyl functionalized alkane, a triglycidyl functionalized alkane, a diglycidyl functionalized arene, or a triglycidyl functionalized arene.

3. A toner in accordance with claim 1 wherein the glycidylfunctionalized reagent is selected from the group consisting of ethanediol diglycidyl ether, propanediol diglycidyl ether, butanediol diglycidyl ether, pentanediol diglycidyl ether, hexanediol diglycidyl ether, 2-methylpropanediol diglycidyl ether, 2-methylbutanediol diglycidyl ether, 2,2-dimethylpropanediol diglycidyl ether, 1,4-dimethylenecylcohexanediol diglycidyl ether, 2,2-dimethylpentanediol diglycidyl ether, bisphenol A diglycidyl ether, bisphenol F diglycidyl ether, bisphenol Z diglycidyl ether, xylenediol diglycidyl ether, ethylene glycol diglycidyl ether, diethylene glycol diglycidyl ether, triethylene glycol diglycidyl ether, epichlorohydrinbutanediol epoxy resins, epichlorohydrin-2,2-dimethylpropanediol epoxy resins, epichlorohydrin-tetraphenylol ethane epoxy resins, epichlorohydrinresorcin epoxy resins, epichlorohydrin-bisphenol A epoxy resins, epichlorohydrin-bisphenol F epoxy resins, epichlorohydrin-bisphenol Z epoxy resins, epichlorohydrin-tetrahydroxyphenylmethane epoxy resins, epichlorohydrin-polyglycol epoxy resins, epichlorohydrin-glycerine triether epoxy resins, and epichlorohydrin-halogenated bisphenol epoxy resins.

4. A toner in accordance with claim 1 wherein the polyisocyanate is a diisocyanate, a triisocyanate, a polyether isocyanate prepolymer, or mixtures thereof.

5. A toner in accordance with claim 1 wherein the polyisocyanate is selected from the group consisting of benzene diisocyanate, toluene diisocyanate, diphenylmethane diisocyanate, hexamethylene diisocynate, and bis(4-isocyanatocyclohexyl)methane.

6. A toner in accordance with claim 1 wherein the polyamine is selected from the group consisting of ethylenediamine, trimethyelenediamine, tetramethylenediamine, pentamethylenediamine, hexamethylenediamine, heptamethylelendiamine, octamethylenediamine, methylpentamethylenediamine, phenylenediamine, 2-hydroxy trimethylenediamine, diethylenetriamine, triethylenetetraamine, tetraethylenepentaamine, xylylenediamine, bis(hexamethylene)triamine, tris(aminoethyl)amine, 4,4'-methylene bis(cyclohexylamine), bis(aminopropyl)ethylenediamine, bis(aminomethyl)cyclohexane, 1,5-diamino-2-methylpentane, piperazine, 2-methylpiperazine, 2,5-dimethylpiperazine, 1,4-bis(3-aminopropyl)piperazine, and 2,5-dimethylpentamethylene diamine.

7. A toner in accordance with claim 1 wherein the core resin binder is an acrylate, a methyacrylate, a styrene, or the copolymers thereof.

8. A toner in accordance with claim 1 wherein the core resin binder is obtained from the polymerization of a monomer or a plurality of monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, dodecyl styrene, methylhexyl styrene, nonyl styrene, and tetradecyl styrene.

9. A toner in accordance with claim 1 wherein the core resin binder is poly(lauryl methacrylate).

10. A toner in accordance with claim 1 wherein the pigment is carbon black, magnetite, or mixtures thereof.

11. A toner in accordance with claim 10 wherein the magnetite selected is Mapico Black or surface treated magnetites.

12. A toner in accordance with claim 1 wherein the pigment is cyan, magenta, yellow, red, blue, green, brown, or mixtures thereof.

13. A toner in accordance with claim 1 wherein the pigment is Heliogen Blue, Pylam Oil Blue, Pylam Oil Yellow, Pigment Blue 1, Pigment Violet 1, Pigment Red, Lemon Chrome Yellow, E.D. Toluidine Red, Bon Red C, Novaperm Yellow FGL, Hostaperm Pink E, Cinquasia Magenta, Oil Red anthraquinone dye, Cl Dispersed Red 15, diazo dye, Cl Solvent Red 19, copper tetra-4-(octadecyl sulfonamido) phthalocyanine, X-copper phthalocyanine pigment, Cl Pigment Blue, Anthrathrene Blue, diarylide yellow 3,3-dichlorobenzidene acetoacetanilides, Cl Solvent Yellow, a nitrophenyl amine sulfonamide, Cl Dispersed Yellow 33, 2,5-dimethoxy-4-sulfonanilide phenylazo-4'-chloro-2,5-dimethoxy acetoacetanilide, or Permanent Yellow FGL.

14. A toner in accordance with claim 1 wherein the polymeric shell represents from 3 percent to 30 percent by weight of toner, the core resin binder represents from 15 percent to 95 percent by weight of toner, and the pigment or dye represents from 1 percent to 70 percent by weight of toner.

15. A toner in accordance with claim 1 containing surface additives.

16. A toner in accordance with claim 15 wherein the surface additives are carbon black, metal salts, metal salts of fatty acids, or colloidal silicas.

17. A toner in accordance with claim 16 wherein zinc stearate is selected.

18. A toner in accordance with claim 15 wherein the additives are present in an amount of from about 0.1 to about 5 weight percent.

19. A toner in accordance with claim 1 wherein the shell is prepared by interfacial polymerization.

20. A toner in accordance with claim 1 wherein the polymer shell is comprised of the interfacial polycondensation product of at least one polyisocyanate, one glycidyl functionalized reagent and one polyamine.

21. A toner in accordance with claim 20 wherein the mole fraction of the glycidyl functionalized reagent to polyisocyanate selected for the shell forming polycondensation with a polyamine is from about 0.1 to about 0.1, while the polyamine is employed in a slight molar excess of from about 0.1 to about 10 percent.

22. A toner in accordance with claim 21 wherein the mole fraction is from about 0.5 to about 0.9.

23. A toner in accordance with claim 20 wherein a plurality of glycidyl functionalized reagents is selected.

24. A toner in accordance with claim 20 wherein a plurality of polyisocyanates is selected.

25. A toner in accordance with claim 20 wherein a plurality of polyamines is selected.

26. A toner in accordance with claim 1 wherein the polyisocyanate is selected from the group consisting of benzene diisocyanate, toluene diisocyanate, diphenylmethane diisocyanate, hexamethylene diisocyanate, bis(4-isocyanatocyclohexyl)methane, the glycidyl functionalized reagent is selected from the group consisting of ethanediol diglycidyl ether, propanediol diglycidyl ether, butanediol diglycidyl ether, pentanediol diglycidyl ether, hexanediol diglycidyl ether, 2-methylpropanediol diglycidyl ether, 2-methylbutanediol diglycidyl ether, 2,2-dimethylpropanediol diglycidyl ether, 1,4-dimethylenecylcohexanediol diglycidyl ether, 2,2-dimethylpentanediol diglycidyl ether, bisphenol A diglycidyl ether, bisphenol F diglycidyl ether, bisphenol Z diglycidyl ether, xylenediol diglycidyl ether, ethylene glycol diglycidyl ether, diethylene glycol diglycidyl ether, triethylene glycol diglycidyl ether, epichlorohydrin-butanediol epoxy resins, epichlorohydrin-2,2-dimethylpropanediol epoxy resins, epichlorohydrin-tetraphenylol ethane epoxy resins, epichlorohydrin-resorcin epoxy resins, epichlorohydrin-bisphenol A epoxy resins, epichlorohydrin-bisphenol F epoxy resins, epichlorohydrin-bisphenol Z epoxy resins, epichlorohydrin-tetrahydroxyphenylmethane epoxy resins, epichlorohydrin-polyglycol epoxy resins, epichlorohydrin-glycerine triether epoxy resins, and epichlorohydrin-halogenated bisphenol epoxy resins; and the polyamine component is selected from the group consisting of ethylenediamine, trimethylenediamine, tetramethylenediamine, pentamethylenediamine, hexamethylenediamine, heptamethyelenediamine, octamethylenediamine, methylpentamethylenediamine, phenylenediamine, 2-hydroxy trimethylenediamine, diethylenetriamine, triethylenetetraamine, tetraethylenepentaamine, xylylenediamine, bis(hexamethylene)triamine, tris(aminoethyl)amine, 4,4'-methylene bis(cyclohexylamine), bis(aminopropyl)ethylenediamine, bis(aminomethyl)cyclohexane, 1,5-diamino-2-methylpentane, piperazine, 2-methylpiperazine, 2,5-dimethylpiperazine, 1,4-bis(3-aminopropyl)piperazine, and 2,5-dimethylpentamethylene diamine.

27. A toner in accordance with claim 1 wherein the polymeric shell contains conductive components.

28. A toner in accordance with claim 27 wherein the conductive components are comprised of carbon black, graphite, or mixtures thereof.

29. A method of imaging which comprises forming by ion deposition on an electroreceptor a latent image, subsequently developing this image with the toner composition of claim 1, and thereafter transferring and fixing the image to a suitable substrate.

30. A method of imaging in accordance with claim 29 wherein there results images with excellent image fixing characteristics.

31. A pressure fixable toner composition comprised of a core comprised of a pigment or dye; and a polymer core resin component selected from the group consisting of acrylate polymers, methacrylate polymers, and styrene polymers, which core is encapsulated within a polymeric shell derived from the interfacial polycondensation of a polyisocyanate and a glycidyl functionalized reagent with a polyamine.

32. A toner composition in accordance with claim 31 wherein the polyisocyanate is selected from the group consisting of toluene diisocyanate, and polyether isocyanate prepolymers; the glycidyl functionalized reagent is selected from the group consisting of ethanediol diglycidyl ether, propanediol diglycidyl ether, butanediol diglycidyl ether, pentanediol diglycidyl ether, hexanediol diglycidyl ether, 2-methylpropanediol diglycidyl ether, 2-methylbutanediol diglycidyl ether, 2,2-dimethylpropanediol diglycidyl ether, 1,4-dimethylenecylcohexanediol diglycidyl ether, 2,2-dimethylpentanediol diglycidyl ether, bisphenol A diglycidyl ether, bisphenol F diglycidyl ether, bisphenol Z diglycidyl ether, xylenediol diglycidyl ether, ethylene glycol diglycidyl ether, diethylene glycol diglycidyl ether, triethylene glycol diglycidyl ether, epichlorohydrinbutanediol epoxy resins, epichlorohydrin-2,2-dimethylpropanediol epoxy resins, epichlorohydrin-tetraphenylol ethane epoxy resins, epichlorohydrinresorcine epoxy resins, epichlorohydrin-bisphenol A epoxy resins, epichlorohydrin-bisphenol F epoxy resins, epichlorohydrin-bisphenol Z epoxy resins, epichlorohydrin-tetrahydroxyphenylmethane epoxy resins, epichlorohydrin-polyglycol epoxy resins, epichlorohydrin-glycerine triether epoxy resins, and epichlorohydrin-halogenated bisphenol epoxy resins; and the polyamine is selected from the group consisting of ethylenediamine, trimethyelenediamine, tetramethylenediamine, pentamethylenediamine, hexamethylenediamine, heptamethylenediamine, octamethylenediamine, methylpentamethylenediamine, phenylenediamine, 2-hydroxy trimethylenediamine, diethylenetriamine, triethylenetetraamine, tetraethylenepentaamine, xylylenediamine, bis(hexamethylene)triamine, tris(aminoethyl)amine, 4,4'- methylene bis(cyclohexylamine), bis(aminopropyl)ethylenediamine, bis(aminomethyl)cyclohexane, 1,5-diamino-2-methylpentane, piperazine, 2-methylpiperazine, 2,5-dimethylpiperazine, 1,4-bis(3-aminopropyl)-piperazine, and 2,5-dimethylpentamethylene diamine.

33. A toner in accordance with claim 31 wherein the pigment is carbon black, magnetites, or mixtures thereof.

34. A toner in accordance with claim 31 wherein the pigment is cyan, magenta, yellow, red, blue, green, brown pigments, or mixtures thereof.

35. A toner in accordance with claim 31 wherein the core resin binder is derived from the polymerization of an addition monomer or monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, dodecyl styrene, methylhexyl styrene, nonyl styrene, and tetradecyl styrene.

36. A method of imaging which comprises forming by ion deposition on an electroreceptor a latent image, subsequently developing this image with the toner composition of claim 31, and thereafter simultaneously transferring and fixing the image to a suitable substrate.

37. A method of imaging in accordance with claim 36 wherein there results images with excellent image fixing characteristics.

38. A method of imaging in accordance with claim 36 wherein fixing is accomplished at pressures of from about 500 psi to about 6,000 psi.

39. A toner composition in accordance with claim 31 wherein the resistivity thereof is from about $10^3$ to about $10^8$ ohm-cm.

40. An encapsulated toner composition comprised of a core comprised of a polymer binder, pigment particles, dye particles, or mixtures thereof, and a polymeric shell derived from the polycondensation of a glycidyl functionalized component, a polyisocyanate and a polyamine.

41. Encapsulated toner compositions comprised of cores comprised of polymer binders, pigment particles, dye particles, and polymeric shells derived from the polycondensation of glycidyl functionalized components, polyisocyanates and polyamines.

42. An encapsulated toner composition comprised of a core comprised of a polymer binder, pigment particles, and a polymeric shell derived from the polycondensation of a glycidyl functionalized component, a polyisocyanate and a polyamine.

43. An encapsulated toner composition comprised of a core comprised of a polymer binder, pigment particles, dye particles, or mixtures thereof, and a polymeric shell derived from polycondensation of a glycidyl functionalized reagent and a polyisocyanate with a polyamine.

44. An encapsulated toner composition comprised of a core comprised of a polymer binder, pigment, and a polymeric shell derived from the polycondensation of a glycidyl-functionalized reagent and a polyisocyanate with a polyamine, and wherein the shell and the core are free of a curing component.

* * * * *